United States Patent [19]

Thomson

[11] 3,978,439

[45] Aug. 31, 1976

[54] RELAY CONSTRUCTION

[76] Inventor: Arthur J. Thomson, 36 Larchwood Drive, Cumberland, R.I. 02864

[22] Filed: June 9, 1975

[21] Appl. No.: 584,719

[52] U.S. Cl. ..... 335/131; 335/126; 335/203

[51] Int. Cl.[2] ..... H01H 50/20

[58] Field of Search ..... 335/131, 203, 187, 192, 335/126, 202

[56] References Cited

UNITED STATES PATENTS

| | | | |
|---|---|---|---|
| 2,929,899 | 3/1960 | Filliette | 335/203 |
| 2,951,922 | 9/1960 | Myrent et al. | 335/126 |
| 3,568,114 | 3/1971 | Cherry et al. | 335/202 |
| 3,828,286 | 8/1974 | Bain | 335/126 |

*Primary Examiner*—Harold Broome
*Attorney, Agent, or Firm*—Max Schwartz

[57] ABSTRACT

A relay comprising a small, flat, rectangular, dielectric housing. A coil mounted in the center of the housing. A U-shaped steel armature at the rear end of the coil having a central arm extending into the coil approximately half way through. A U-shaped steel armature mounted in a teflon slide at the front end of the coil and having a central arm extending into the coil approximately, 0.020 inch from the rear arm. The teflon slide being slidable along the rear armature side arms against the action of a leaf spring. A pair of contact prongs extending from the front of the housing and having integral portions in the housing bent at right angles toward each side and then bent again toward the rear. A movable contact arm extending rearwardly from each inner prong arm toward a rear contact at each rear corner of the housing. The movable contact arms being normally spaced from the rear contacts approximately 0.018 inch. Each contact arm has an enlarged annular portion at the center. Each side of the teflon slide has a teflon roll contacting the annular portions at 45°, whereby, when the coil is energized, the front armature will be pulled rearwardly 0.020 inch with the teflon slide and the teflon rolls will cause the contact arms to move outwardly to close the contacts. Conversely, when the coil is then de-energized, the leaf spring will slide the armature into open position opening the contacts.

20 Claims, 5 Drawing Figures

RELAY CONSTRUCTION

BACKGROUND OF THE INVENTION

Conventional relays handling 10 to 15 amp. currents are comparatively standard in construction. They vary in size, but are usually about 2 inches long and 1 to 1½ inches square in cross section. Basically, these relays are made to intercept or interrupt the flow of electrical current on signal from an outside source. It has been proposed to utilize such a relay with miniaturized circuits, usually board mounted, for a variety of uses. To do so, the relay must be reduced in bulk while still retaining sufficient contact size to handle the required electrical capacity. This is virtually impossible with the conventional relay and relay constructions.

SUMMARY OF THE INVENTION

The present invention provides a relay construction and operation which permits the relay to be housed in a flat rectangular housing approximately ½ inch thick and 1½ by 1⅝ inches. To do this and still maintain capacity, all the relay operational movements have been transferred to a horizontal movement. The relay coil is mounted in the center of the housing. A fixed armature is mounted at one end and a movable armature at the other end, the arms from each forming a gap of 0.020 inch in the center of the coil. A pair of contact prongs extend from the front wall of the housing and another pair of contacts extend from each rear corner. The rear contacts are normally in open position and the contacts are closed horizontally when the coil is energized to slide the movable armature toward the fixed armature.

DESCRIPTION OF THE INVENTION

Figure 1:
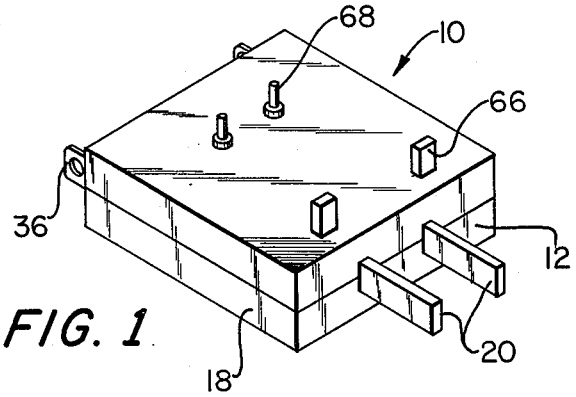
FIG. 1 is a perspective view of a relay embodying my present invention.

Referring more in detail to the drawings, the relay is mounted in a rectangular housing 10 made of a phenolic dielectric material approximately ½ inch in thickness, 1⅝ inches in length and 1½ inches in width. The housing 10 has a front wall 12, rear wall 14, and side walls 16 and 18.

A pair of contact prongs 20 extend outwardly through the front wall 12 for plugging into a conventional electrical receptacle. At the rear of each contact prong 20, immediately on the inside of the front wall 12, each prong is bent at right angles in opposite directions to form a portion 22 extending to the adjacent side wall 16 or 18. At the side walls, each portion 22 is again bent at right angles to form a portion 24 extending along the side walls short of the central point of each wall.

Now, a doubled strip of phosphor bronze metal is mounted on each portion 24 to form a contact arm 26. The arms 26 extend rearwardly a short distance and are then bent in a Z-bend 28 to space the arms 26 from the side walls. The arms 26 extend to the rear of the housing. However, midway of the ends each arm is provided with an annular enlarged bump 30 formed by separating the strips of metal. At the rear end, each contact arm 26 is provided with a contact element 32 normally spaced 0.018 inch from a fixed contact 34 having a contact arm 36 extending rearwardly from the housing.

With the above construction, when the contact prongs 20 are inserted in an electrical receptacle, current can flow along the contacts and be taken off at the rear arms 36 whenever the elements 32 and 34 are in contact. When the gap between the contacts is open the full 0.018 inch the continuity is broken and no current can flow. Movement of the contact arms 26 to open and close the gap is the function of the relay construction.

A coil 38, approximately 8000 ohms, is mounted in the housing 10 at the center in axial alignment front to rear and parallel with the side walls 16 and 18. At the rear of the coil 38 is a steel armature in fixed position having a transverse arm 40 across the rear of the coil and three parallel arms extending from the arm 40 at right angles, arms 42 from each end extending on the ouside of the coil 38 and central arm 44 extending into the coil. The arms 42 and 44 are of equal length and extend approximately ½ the length of the coil 38. The armature is preferably of No. 2 relay steel. The rear wall 14 is provided with an integral central forwardly extended portion 46 which extends to the fixed armature to hold it in position.

At the front of the coil 38 is a movable armature of the identical construction as the rear armature. It comprises a transverse arm 48 and parallel arms 50 at each side and 52 in the center. The arms 50 and 52 are of such length that in their normal position they extend 0.020 inch from the ends of the rear armature arms 42 and 44. The movable front armature is mounted in a generally U-shaped teflon slide member 54 having opposed grooves 56 on the parallel arms, the grooves 55 sliding along the outside of the arms 42 of the fixed armature. The front edge of the teflon slide member 54 is provided with a forwardly extending centering positioner portion 58.

At the rear, the portion 46 of the rear wall is provided with a transverse slot 60 in which a leaf spring 62 is frictionally mounted. The ends of the leaf spring 62 bear against the ends of the teflon slide member 54 to bias the slide member 54 and the movable armature forwardly to normally maintain the gap of 0.020 inch between the ends of the central arms 44 and 52. Also, the outside of the teflon slide member arms are provided with an inserted teflon roll on each side at 64 which contact the annular bumps 30 on the arms 26 at an angle of 45°.

The operation of the relay is now obvious. When the coil 38 is energized, the front movable armature and the teflon slide are pulled rearwardly 0.020 inch until the ends of the armature arms close the gap. During this movement, the teflon rolls 64 bear against the bumps 30 and force the contact arms 26 outwardly toward the side walls. Since the contact gap at the rear is only 0.018 inch, contact is immediately made and the current will flow as long as the coil is energized. When the coil is de-energized by a suitable outside signal, the spring 62 pushes the teflon slide and movable armature forwardly 0.020 inch to break the contacts and interrupt the current.

Figure 2:
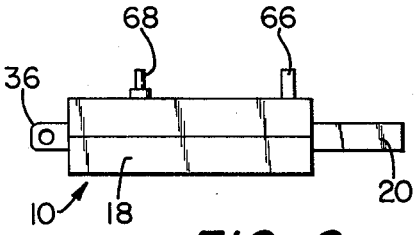
FIG. 2 is a side elevation thereof.
Figure 3:
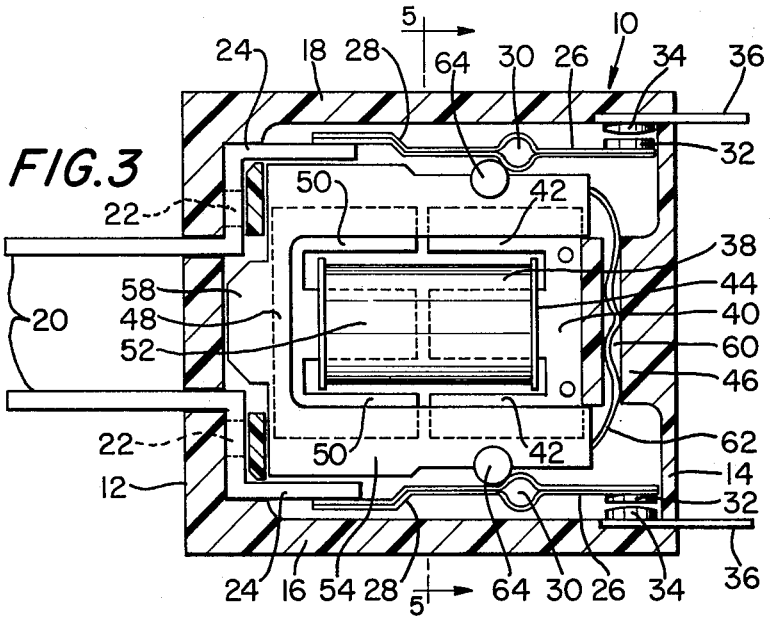
FIG. 3 is an enlarged top plan view of the relay in de-energized position with the top of the housing removed.
Figure 4:
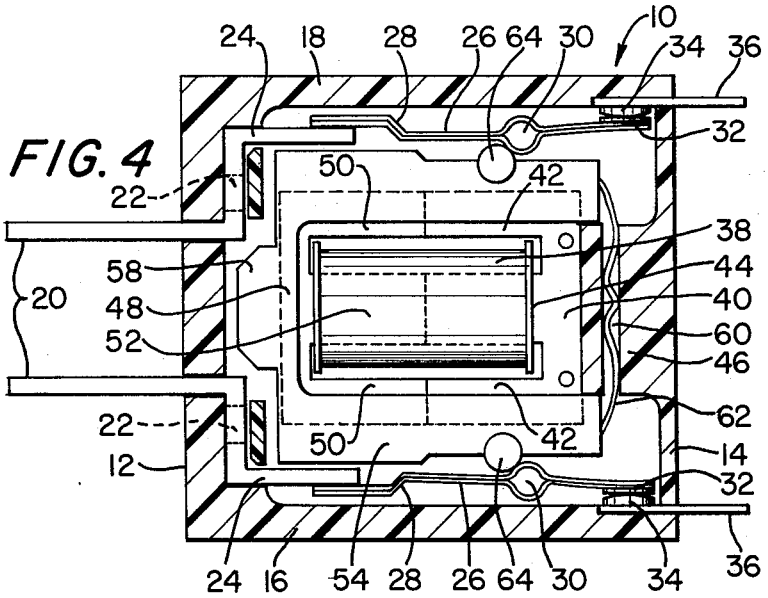
FIG. 4 is a view similar to FIG. 3 with the relay in energized position.
Figure 5:
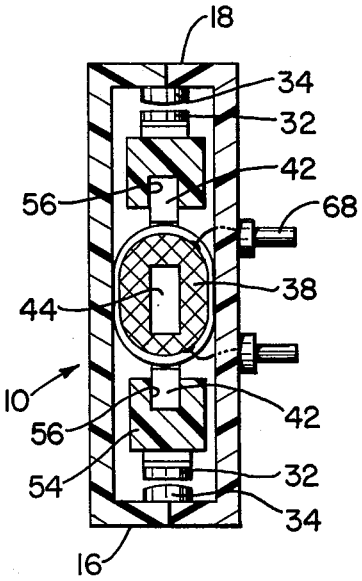
FIG. 5 is a section taken on line 5—5 on FIG. 3.

As can be seen in FIGS. 2 and 5, the relay is provided with brass input terminals 66 and brass coil terminals 68 for mounting and connecting the relay to a suitable circuit. The terminals 66 and 68 are so designed that a printed circuit board can readily be mounted thereon. These printed circuits are usually the same size as the relay, approximately 1⅝ by 1½ inch. For example, the relay of the present invention can be used as a ground fault interceptor relay. There is a circuit which can sense a ground fault or short in a line. By mounting this on the relay and mounting the combination in a power line to a hand tool, a super-safe device is provided. If a short develops, the circuit will sense it and the relay will cut the current. All this happens in microseconds so that the user is not electrocuted by the short. This relay and circuit can therefore be molded directly into the extension cord to the tool without too much bulk.

The relay is not only compact in design but simple and easy to manufacture and assemble. Other advantages of the present invention will be readily apparent to a person skilled in the art.

I claim:

1. A relay comprising a flat, rectangular, dielectric housing having front, rear, and side walls, a pair of contact prongs extending forwardly through said front wall, a pair of contact arms extending rearwardly through said rear wall, a fixed contact element in said housing at the inner end of each of said contact arms, a movable contact element adjacent each of said fixed contact elements with a narrow gap therebetween, each said movable contact elements being mounted on a movable conductor arm, each movable conductor arm being mounted on the inner end of one of said contact prongs, a coil mounted in said housing, a fixed armature at the rear end of said coil, a movable armature at the front end of said coil, means for biasing said movable armature away from said fixed armature, said movable armature moving rearwardly into contact with said fixed armature when said coil is energized, and means associated with said movable armature for moving said movable conductor arms to close the gap between said contact elements when said coil is energized, said biasing means moving said movable armature away from said fixed armature to allow said conductor arms to move said contact elements apart when said coil is de-energized.

2. A relay as in claim 1, wherein said movable conductor arms comprise doubled strips of phosphor bronze with suitable contact elements.

3. A relay as in claim 1, wherein said biasing means comprises a leaf spring mounted transversely in said housing adjacent the rear end of said coil.

4. A relay as in claim 1, wherein said fixed armature comprises a steel member having a transverse arm across the rear end of said coil and three spaced parallel integral arms extending at right angles, the outer arms being on the outside of said coil and the central arm extending into said coil, said arms being approximately half the length of said coil, and wherein said movable armature comprises a steel member having a transverse arm across the front end of said coil and three spaced parallel integral arms extending at right angles, the outer arms being on the outside of said coil and the central arm extending into said coil, the ends of said movable armature arms being spaced approximately 0.020 inch from the ends of said fixed armature arms when said coil is de-energized.

5. A relay as in claim 1, wherein said movable armature is mounted in a generally U-shaped teflon slide member.

6. A relay as in claim 5, wherein said teflon slide member is provided with grooves slidable on the side edges of the fixed armature.

7. A relay as in claim 1, wherein brass input and brass coil terminals extend from said housing, whereby a printed circuit board may be mounted on said housing in circuit with said relay.

8. A relay as in claim 2, wherein said biasing means comprises a leaf spring mounted transversely in said housing adjacent the rear end of said coil.

9. A relay as in claim 4, wherein said biasing means comprises a leaf spring mounsted transversely in said housing adjacent the rear end of said coil, the ends of said leaf spring bearing against said movable armature.

10. A relay as in claim 4, wherein said movable conductor arms comprise doubled strips of phosphor bronze with suitable contact elements.

11. A relay as in claim 10, wherein said biasing means comprises a leaf spring mounted transversely in said housing adjacent the rear end of said coil, the ends of said leaf spring bearing against said movable armature.

12. A relay as in claim 4, wherein said movable armature is mounted in a generally U-shaped teflon slide member.

13. A relay as in claim 12, wherein said teflon slide member is provided with grooves slidable on the side edges of said fixed armature.

14. A relay as in claim 11, wherein said movable armature is mounted in a generally U-shaped teflon slide member.

15. A relay as in claim 14, wherein said teflon slide member is provided with grooves slidable on the side edges of said fixed armature.

16. A relay as in claim 8, wherein said movable armature is mounted in a generally U-shaped teflon slide member.

17. A relay as in claim 16, wherein said teflon slide member is provided with grooves slidable on the side edges of said fixed armature.

18. A relay as in claim 16, wherein said moving means comprises a teflon roll member in each side of said slide, an enlarged bump area in each of said movable contact arms, said rolls contacting said bumps during the movement of said movable armature.

19. A relay as in claim 18, wherein said teflon slide member is provided with grooves slidable on the side edges of said fixed armature.

20. A relay as in claim 19, wherein brass input and brass coil terminals extend from said housing, whereby a printed circuit board may be mounted on said housing in circuit with said relay.

* * * * *